US008683964B2

(12) United States Patent
Van Rooyen

(10) Patent No.: US 8,683,964 B2
(45) Date of Patent: Apr. 1, 2014

(54) TWO-STROKE ENGINES

(75) Inventor: Basil Van Rooyen, St Ives (AU)

(73) Assignee: Cits Engineering Pty Ltd (AU)

( * ) Notice: Subject to any disclaimer, the term of this patent is extended or adjusted under 35 U.S.C. 154(b) by 15 days.

(21) Appl. No.: 13/509,888

(22) PCT Filed: Nov. 16, 2010

(86) PCT No.: PCT/AU2010/001524
§ 371 (c)(1),
(2), (4) Date: May 15, 2012

(87) PCT Pub. No.: WO2011/057353
PCT Pub. Date: May 19, 2011

(65) Prior Publication Data

US 2012/0227717 A1 Sep. 13, 2012

(30) Foreign Application Priority Data

Nov. 16, 2009 (AU) ..... 2009238281

(51) Int. Cl.
*F02B 75/22* (2006.01)
*F02B 25/00* (2006.01)
*F02B 25/14* (2006.01)

(52) U.S. Cl.
USPC ..... 123/65 V; 123/73 R; 123/73 AB; 123/65 R; 123/65 P; 123/184.31; 123/54.4

(58) Field of Classification Search
USPC ..... 123/73, 73 AB, 65 R, 65 V, 65 P, 65 SP, 123/184.31, 54.4
See application file for complete search history.

(56) References Cited

U.S. PATENT DOCUMENTS

| | | | | |
|---|---|---|---|---|
| 3,472,211 | A * | 10/1969 | Meininger | 123/73 R |
| 3,759,493 | A * | 9/1973 | Blanchard et al. | 261/23.2 |
| 4,345,551 | A | 8/1982 | Bloemers | |
| 4,509,472 | A | 4/1985 | Slattery | |
| 4,527,392 | A * | 7/1985 | Sato et al. | 60/313 |
| 4,784,090 | A | 11/1988 | Sougawa | |
| 5,168,838 | A * | 12/1992 | Seike et al. | 123/184.31 |
| 6,375,525 | B1 * | 4/2002 | Kanno | 440/87 |
| 2002/0029759 | A1 * | 3/2002 | Akagi et al. | 123/336 |

FOREIGN PATENT DOCUMENTS

JP 57179358 11/1982

OTHER PUBLICATIONS

International Search Report for PCT/AU2010/001524, Completed by the Australian Patent Office on Feb. 17, 2011, 2 Pages.

* cited by examiner

*Primary Examiner* — Lindsay Low
*Assistant Examiner* — Tea Holbrook
(74) *Attorney, Agent, or Firm* — Brooks Kushman P.C.

(57) ABSTRACT

A two-stroke, internal combustion engine which includes at least one set of paired first and second cylinders. The engine includes an air or air/fuel mixture inlet conduit bifurcated into inlet passages extending to respective first and second inlet ports of the first and second cylinders. A valve controls the passage of air or air/fuel mixture into the inlet passages. In one embodiment of the engine, a bypass passage provided with a bypass valve extends between the inlet ports of the paired cylinders.

18 Claims, 4 Drawing Sheets

TWO-STROKE ENGINES

CROSS-REFERENCE TO RELATED APPLICATION

This application is the U.S. national phase of PCT Appln. No. PCT/AU2010/001524 filed on Nov. 16, 2010, which claims priority to Patent Application No. 2009238281 filed on Nov. 16, 2009, the disclosures of which are incorporated in their entirety by reference herein.

The present invention relates to two-stroke internal combustion engines and, more particularly, throttle control and increased efficiency of twin or paired cylinder two-stroke engines.

BACKGROUND

The advantages of typical two-stroke internal combustion engines, which include relatively higher power to weight ratio over a comparable displacement four-stroke engine and fewer moving parts, is offset by the disadvantages of total loss lubrication, with the inherent pollution of the burnt oil in combustion, and expensive roller bearings associated therewith.

Two-stroke engines typically cannot use a pressurised lubrication system and oil is added to the air/fuel mixture to allow lubrication of the piston within the cylinder.

Thus two-stroke engines burn oil, accounting for extra pollution. A lack of a pressurised lubrication system requires roller bearings on the crankshaft and con-rods which are able to operate in the oil/fuel mix, unlike cheaper and simpler slipper bearings. This requires a heavy and expensive crankshaft to be assembled around the roller-bearings.

Petrol Internal combustion engines typically also lose fuel efficiency, when throttled and at idle, due to the engine having to do work to overcome the "pumping" action of the piston on its up-stroke as it creates a partial vacuum down stream of the throttle valve. This is commonly referred to as pumping losses.

In paired cylinder engines, with the pairs of pistons arranged at 180 degrees apart (that is one piston is at top dead centre (TDC) when the other of the pair is at bottom dead centre (BDC), pumping losses from the vacuum down-stream of the inlet butterfly valve impact negatively on the fuel economy of the engine which must do work to overcome these losses.

Additionally, the common reed valve used as a check or one-way valve in the two-stroke induction cycle, has a tension resistance to be overcome, for it to be opened by the pressure differentials during induction. This increases resistance and thus flow, with reductions in efficiency, and is another contributor to pumping losses. Furthermore, the bulky reed valve block necessitates great cross sectional changes in the induction port, resulting in changes of charge velocity, in turn reducing charge, flow, power, efficiency, ram-effect and economy. The pivot valve described, in contrast, has no such tension loads to overcome, and maintains a greater consistency of inlet port cross sectional area, and hence flow speed, and improved ram effect.

It is an object of the present invention to address or at least ameliorate some of the above disadvantages.

Notes

1. The term "comprising" (and grammatical variations thereof) is used in this specification in the inclusive sense of "having" or "including", and not in the exclusive sense of "consisting only of".

2. The above discussion of the prior art in the Background of the invention, is not an admission that any information discussed therein is citable prior art or part of the common general knowledge of persons skilled in the art in any country.

BRIEF DESCRIPTION OF INVENTION

In a first broad form of the invention, there is provided a two-stroke, internal combustion engine; said engine including at least one set of paired first and second cylinders; said engine including an air or air/fuel mixture inlet conduit bifurcated into first and second inlet passages extending to respective first and second inlet ports of said first and second cylinders; air or air/fuel flow through said first and second inlet passages controlled by induction valves located proximate said bifurcation of said inlet conduit; said engine characterised by a bypass passage extending between said first and second inlet ports of said first and second cylinders; said bypass passage provided with a bypass valve; said bypass valve operable by an operator of said engine between a fully open position and a fully closed position of said bypass passage.

Preferably, flow of at least air through each of said first and second inlet passages is controlled by said induction valves; each induction valve of each of said inlet passages arranged to operate in concert such that a closing movement of a first one of said induction valves is complemented by an opening movement of a second one of said induction valves.

In another broad form of the invention, there is provided a two-stroke, internal combustion engine; said engine including at least one set of paired first and second cylinders; said engine including an air or air/fuel mixture inlet conduit bifurcated into inlet passages extending to respective first and second inlet ports of said first and second cylinders; said engine characterised in that said engine includes a pivoting two-leaved inlet valve comprising two rigidly interconnected leaves; said pivoting inlet valve located at said bifurcation of said inlet conduit; said pivoting two-leaved, inlet valve alternately pivoting such that a first leaf of said two-leaved pivot valve opens said first inlet passage as a piston of said first cylinder moves from bottom dead centre (BDC) to top dead centre (TDC); a second leaf of said pivoting two-leaved inlet valve closing said second inlet passage as a piston of said second cylinder moves from TDC to BDC.

Preferably, said engine is further provided with a bypass passage extending between said first and second inlet ports of said first and second cylinders; said bypass passage provided with a bypass valve; said bypass valve operable by an operator of said engine between a fully open position and a fully closed position of said bypass passage.

Preferably, first and second pistons of said at least one set of paired first and second cylinders operate on a common crankshaft; said first and second pistons pivotally connected by respective connecting rods to first and second journals of said common crankshaft.

Preferably, each of said first and second cylinders is provided with a separate crankcase.

In another broad form of the invention, there is provided a two-stroke, internal combustion engine; said engine including at least one set of paired first and second cylinders; said engine including an air or air/fuel mixture inlet conduit bifurcated into first and second inlet passages; said first and second inlet passages extending to respective first and second inlet ports of said first and second cylinders; said engine characterised in that said engine includes a pivoting two-leaved inlet valve located at said bifurcation of said inlet conduit; said pivoting two-leaved inlet valve alternately pivoting such that a first leaf of said two-leaved pivot valve closes one of said first and second inlet passages while as second leaf of said two-leaved pivoting valve opens another of said first and second inlet passages; said engine further characterised in that a bypass passage extends between said first and second inlet ports; said bypass passage provided with a bypass valve; said bypass valve operable by a user of said engine between a fully open position and a fully closed position of said bypass passage.

Preferably, respective first and second pistons of said at least one set of paired first and second cylinders, reciprocate alternately between BDC and TDC of respective said cylinders; said pistons arranged at 180 degrees such that when a first of said pistons is at TDC a second of said pistons is at BDC.

Preferably, said first and second cylinders share a common crankcase; each of said first and second cylinders divided into upper and lower cylinder sections by fixed separator plates; first and second pistons moving reciprocatingly between TDC and BDC in respective said upper cylinder sections.

Preferably, each of said first and second pistons divides a respective upper cylinder section into compression chamber portion and a combustion chamber portion; said compression chamber portion located between an underside of a said piston and a respective said fixed separator plate.

Preferably, a post extends from an underside of each said piston; said post passing through a central aperture in said fixed separator plate; a lower end of said post connected to a disc or slipper-like element moving reciprocatingly in said lower cylinder section; said disc or slipper-like element provided at an underside with gudgeon element for connection to a first end of connecting rod; said connecting rod connected at a second end to a journal of said common crankshaft.

Preferably, a charge of air or air/fuel mixture inducted into a said compression chamber portion of a said cylinder as a piston in that cylinder moves towards TDC, is subsequently at least partially transferred to respective said combustion chamber portion of said cylinder through a transfer port.

Preferably, said charge of air or air/fuel mixture inducted into a said compression chamber portion is a maximum charge when said bypass valve is in a position closing said bypass passage.

Preferably, when said bypass valve is partially or fully open, said bypass passage allows a transfer of air or air/fuel mixture between said compression chamber portion of said first cylinder and said compression chamber portion of said second cylinder.

Preferably, an open or partially open bypass valve causes a relief in pressure in a said compression chamber portion and a corresponding said inlet passage when a said piston in a corresponding cylinder moves towards BDC; said pivot valve reacting proportionally to the degree of relief caused by said by-pass valve.

Preferably, said pivot valve assumes a tendency towards closure, though not necessarily full closure, of one said inlet passage when said piston in said corresponding cylinder moves towards BDC and a tendency towards opening, though not necessarily full opening, of the other said inlet passage.

Preferably, when said bypass passage is fully or partially open, weaker charges of air or air/fuel mixture for compression are transferred to said combustion chamber portions; said charges reduced from said maximum charges; said weaker charges leading to a reduced, slower power stroke and a reduction in rpm and power output.

Preferably, said by-pass valve, said first and second inlet passages, and said pivot valve and said inlet conduit are so sized, that when said by-pass valve is fully open, sufficient air or air/fuel mixture passes to said combustion chamber portions to maintain said engine at idle.

Preferably, said charge of air or air/fuel mixture is a charge of air only; each of said first and second combustion chambers provided with a fuel injector for delivery of a precisely metered volume of fuel; said volume proportionate to the status of said by-pass valve.

In a further broad form of the invention, there is provided a method of controlling rpm and power output of a two-stroke engine; said engine including at least one set of paired first and second cylinders; said method including the steps of operating a bypass valve in a bypass passage between a fully open and a fully closed position; said bypass passage extending between an inlet port of said first cylinder and an inlet port of said second cylinder; said engine operating at maximum power output when said bypass valve fully closes said bypass passage; said engine operating at idle when said bypass valve fully opens said bypass passage.

Preferably, each said inlet port of said first and second cylinders communicates with an inlet passage extending from a bifurcation of an air or air/fuel inlet conduit; said inlet passages extending to respective said first and second inlet ports.

Preferably, a two-leaved pivot valve located as said bifurcation is responsive to the position of said bypass valve; said pivot valve alternately fully or partially opening and fully or partially closing each of said inlet passages when said bypass valve is fully closed; said pivot valve alternately fully or partially opening and fully or partially closing said inlet passages when said bypass valve is partially or fully open.

In still another broad form of the invention, there is provided a method of controlling induction of an air or air fuel mixture into paired first and second cylinders of a two-stroke internal combustion engine; said method comprising provision of a pivoting two-leaved pivot valve at the bifurcation of an inlet conduit of said engine; leaves of said two-leaved pivot valve rigidly interconnected and arranged one to the other at an angle approximately equal to the angle of bifurcation; respective inlet passages extending from said bifurcation to respective inlet ports of said paired cylinders.

Preferably, said two-leaved pivot valve located at said bifurcation is responsive to the position of a bypass valve; said bypass valve located in a bypass passage extending between said inlet port of said first cylinder and said inlet port of said second cylinder; said engine operating at maximum power output when said bypass valve fully closes said bypass passage; said engine operating at idle when said bypass valve fully opens said bypass passage; said pivot valve alternately fully or partially opening and fully or partially closing each of said inlet passages when said bypass valve is fully closed; said pivot valve alternately partially opening and partially closing said inlet passages when said bypass valve is partially or fully open.

BRIEF DESCRIPTION OF DRAWINGS

Embodiments, of the present invention will now be described with reference to the accompanying drawings wherein.

DETAILED DESCRIPTION OF PREFERRED EMBODIMENTS

Note:

In this specification, the term "paired cylinder two-stroke internal combustion engine" refers to a two cylinder engine or engines with at least one but possibly multiple cylinders arranged in-line in cooperating pairs.

In this specification also, the terms top dead centre and bottom dead centre refer to the upper and lower ends of an internal combustion engine piston stroke in its cylinder and are generally referred to by the acronyms TDC and BDC respectively.

First Preferred Embodiment

Figure 1:
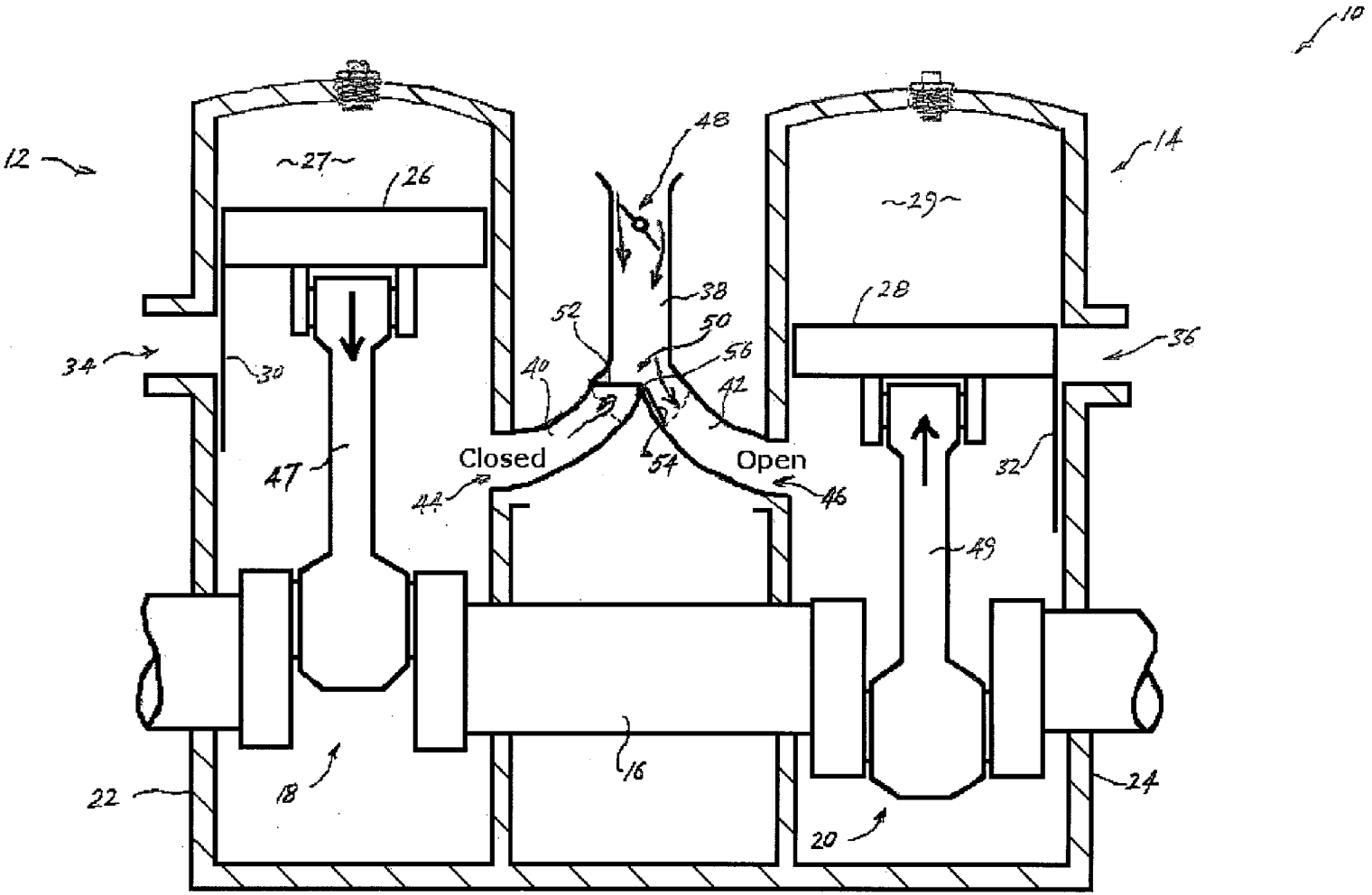
FIG. 1 is schematic sectioned side view of a first preferred embodiment of a set of paired first and second cylinders of a two-stroke engine fitted with a pivot valve according to the invention.

In a first preferred embodiment of the invention with reference to FIG. 1, a paired cylinder two-stroke internal combustion engine 10 includes at least one pair of cylinders 12 and 14 sharing a common crankshaft 16 but with their big end journals 18 and 20 operating in separate crankcases 22 and 24. The crankshaft journals 18 and 20 are offset one to the other by 180 degrees so that when first piston 26 is at top dead centre (TDC), second piston 28 is at bottom dead centre (BDC).

The pistons 26 and 28 are each provided with skirts 30 and 32 respectively, which control the opening of the exhaust ports 34 and 36, as well understood in the art. Again as well understood in the art, transfer ports (not shown) allow the transfer of gasses, initially inducted into each crankcase 22 and 24 below the pistons, to the combustion chambers 27 and 29 respectively, above the piston, as each piston moves from TDC toward BDC.

In the present arrangement, an air or air/fuel mixture is provided to the two cylinders 12 and 14, from a common inlet conduit 38 which is bifurcated into two passages 40 and 42 leading to inlet ports 44 and 46 respectively, of the first and second cylinders 12 and 14. A butterfly valve 48 is provided in the inlet conduit 38 to regulate the flow of the air or air/fuel mixture through the conduit, again as is common in the art.

In the present preferred embodiment of the invention however, the control of induction of the air or air/fuel mixture available at the inlet conduit 38 into the bifurcated passages 40 and 42, is by means of a single element, two-leaved pivot valve 50 located at the bifurcation of the inlet conduit 38. The leaves 52 and 54 of the pivot valve 50 are similar to those of reed valves, and have some flexibility, but in this case, the two leaves 52 and 54 are rigidly interconnected and fixed at an angle to each other approximately equal to the angle of bifurcation, and freely pivot about a pivot shaft 56 rigidly mounted at the bifurcation. Unlike commonly used spring reed valves, the movement of the pivot valve 50 is not resisted by spring tension. As can be seen in FIG. 1, when the pivot valve 50 is rotated so that leaf 52 of the first passage 40 is in the closed position, leaf 54 of the second passage 42 is rotated into the fully open position.

The pivoting of the pivot valve 50 is induced by the cyclic pressure differentials between that obtaining in the inlet conduit 38 and the bifurcated inlet passages 40 and 42. It will be understood, with reference to FIG. 1, that when the second piston 28 of the second cylinder 14 is moving towards TDC as indicated by the arrow on it connecting rod 49, a partial vacuum is created in the second cylinder crankcase 24 below the piston 28. Hence a suction force is applied to leaf 54, forcing the pivot valve 50 to rotate and open the inlet passage 42 for an inflow of air or air/fuel mixture. This pivoting of the pivot valve 50 is aided by the increase in pressure building up under the first piston 26 as it moves simultaneously towards BDC. This increases the pressure in inlet passage 40, thus applying pressure on leaf 52 to force it into the position closing the inlet passage 40 as shown in FIG. 1.

By being freely pivoting, the pivot valve 50 of the invention allows an efficient induction of a fresh air or air/fuel mixture into the crankcase of the cylinder in which the piston is moving towards TDC, while at the same time providing for efficient transfer of the air or air/fuel mixture from below the other piston of the pair of cylinders, via transfer ports (not shown) to its combustion chamber, as it moves towards BDC. The leaves 52 and 54 of the single element two-leaved pivot valve are flexible to allow for both to remain at least partially open at high RPM when the inflow velocity through inlet conduit 38 is high enough to overcome reverse flow.

Second Preferred Embodiment

Figure 2:
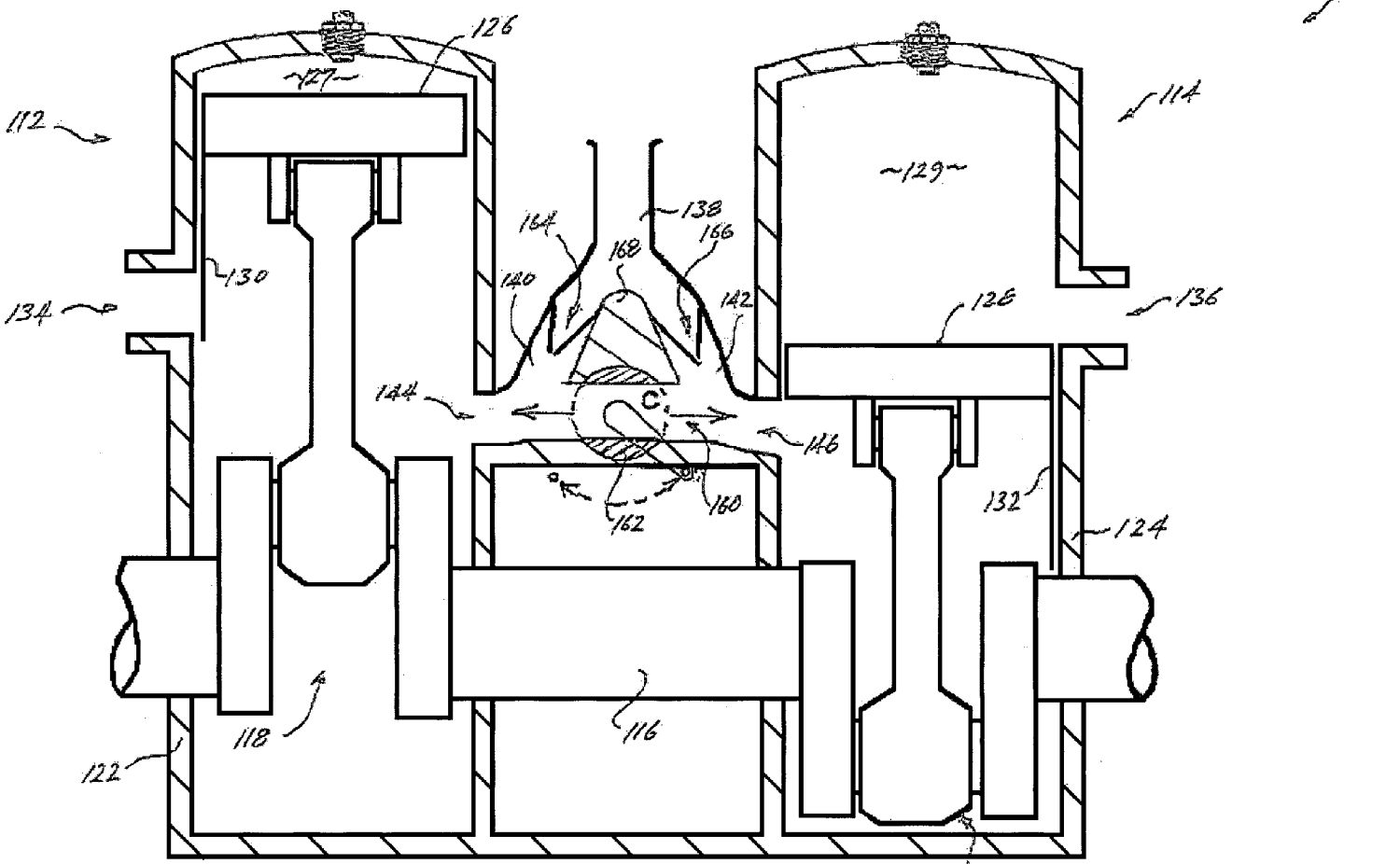
FIG. 2 is a schematic sectioned side view of the two-stroke engine of FIG. 1 provided with induction check valves and with a bypass passage and bypass valve.

With reference to FIG. 2, (in which like features are like numbered with the addition of 100) in this arrangement of a two-stroke, paired cylinder engine 110, the engine includes cylinders 112 and 114, pistons 126 and 128, and a common crankshaft 116. As in the first preferred embodiment above, the crankshaft journals 118 and 120 which are arranged at 180 degree separation, operate in separate crankcases 122 and 124.

Again as before, the first and second cylinders 112 and 114 are supplied by air or an air/fuel mixture via a common inlet conduit 138 which also is bifurcated into inlet passages 140 and 142 respectively, leading to inlet ports 144 and 146 of the first and second cylinders.

In the present embodiment however, a bypass passage 160 is provided between the inlet port 144 of the first cylinder 112 and the inlet port 146 of the second cylinder 114. Located at the midpoint of this bypass passage 160, is a bypass valve 162, which is adapted to restrict fluid flow through passage 160, from a fully open position as shown in FIG. 2, to a fully closed position under the control of an operator of the engine. Preferably, the bypass valve 162 is a rotary valve as illustrated in FIG. 2.

Flow of air or air/fuel mixture through the bifurcated inlet passages 140 and 142 is, in this instance, controlled by two reed valves or other induction valves 164 and 166, as known in the art, located in each inlet passage below the bifurcation point 168. It will be noted that there is no butterfly valve shown in the inlet conduit 138 above the bifurcation point.

(In practice a butterfly valve may be provided in the inlet conduit, not for throttle control, but for the purpose of idle setting. Above these very slow engine idle speeds, this butterfly valve would open fully, and the engine speed and power would be controlled solely by the by-pass valve, and not by the butterfly valve or any other throttle arrangement upstream of the bifurcation point.)

The opening and closing of the reed valves 164 and 166 is in response to the pressure differentials obtaining in each of the two inlet passages 140 and 142 as the pistons 126 and 128 alternately induce positive and negative pressures at the reed valves by the movements of the pistons between TDC and BDC as described in the first preferred embodiment above, in the usual way.

These pressure differentials however, are now moderated by the position of the bypass valve 162. It will be understood that with the bypass valve 162 fully closed, the pressures acting at the reed valves 164 and 166 are the same as described in the first preferred embodiment above. Thus the reed valve of each inlet passage opens when a negative pressure is induced by the movement towards TDC of the corresponding piston. The reed valve of the other inlet passage defaults to its closed position, assisted by positive pressure in its inlet passage by the movement of its corresponding piston towards BDC.

There being no throttle control butterfly valve in the inlet conduit 138, the fully closed position of the bypass valve 162 corresponds to the engine receiving maximum flow of air or air/fuel, thus operating at full "throttle" and maximum power. As the bypass valve 162 is rotated from a fully closed position towards a fully open position, the air or air/fuel mixture, being alternately compressed and decompressed in the opposing crankcase voids, can cross-feed or "short-circuit" between these voids in proportion to the degree of opening of the bypass valve 162. This is due to the pressure differentials between each crankcase, being greater than the pressure obtaining in the inlet conduit 138.

The effect of opening the bypass valve 162 is thus to moderate the positive and negative pressures at the reed valves 164 and 166 in the inlet passages 140 and 142, thereby reducing the induction of air or air/fuel mixture into each of the crankcase 122 and 124, and consequently into each combustion chamber 127 and 129. When the bypass valve 162 is fully open, the engine operates at idle.

Thus the bypass valve 162 acts as the throttle for the engine replacing the usual butterfly throttle.

By means of this arrangement, in part-throttle conditions such as during idle, cruise and city driving, the pumping losses incurred in maintaining the partial vacuum downstream of a conventional butterfly throttle, are largely eliminated. This contributes to the efficiency and economy of the engine, since in a conventional butterfly controlled arrangement, the engine must do work and use fuel to overcome such pumping losses.

Third Preferred Embodiment

Figure 3:
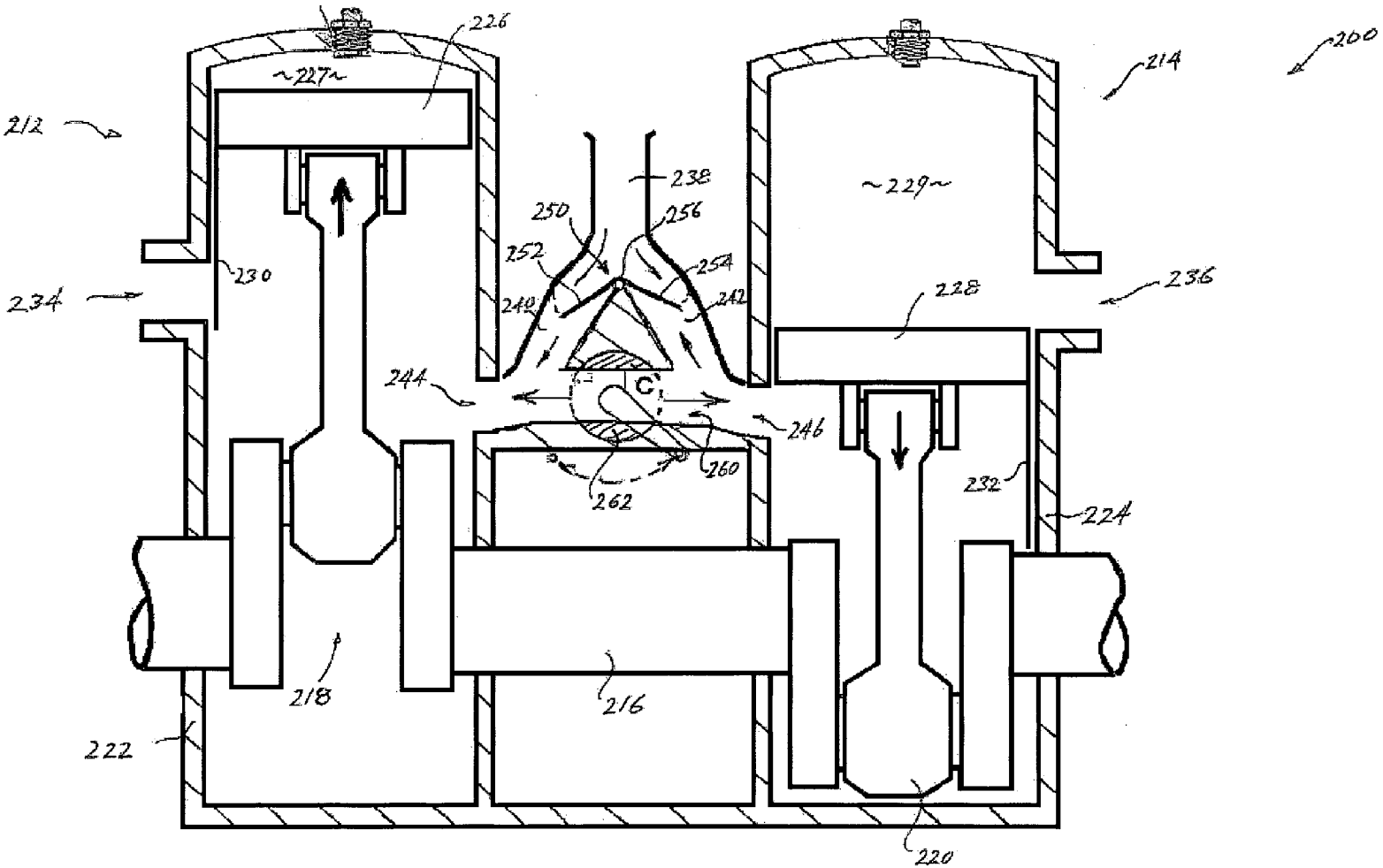
FIG. 3 is a schematic sectioned side view of the engine of FIG. 2 fitted with the pivot valve of FIG. 1.

In this third preferred embodiment according to the invention and with reference to FIG. 3 (in which corresponding features are similarly numbered but with the addition of 200), the paired cylinder 212 and 214 arrangement, the separated crankcases 222 and 224 and bifurcated inlet passages 240 and 242 extending to inlet ports 244 and 246 from a common inlet conduit 238, are as described for the first and second embodiments above. In this embodiment also, a bypass passage 260 extends between the inlet ports 244 and 246 of the two cylinders 212 and 214, and is again provided with a bypass valve 262 replacing a conventional butterfly valve.

In this embodiment however, the reed valves or similar induction valves of the second embodiment, are replaced with a single element two-leaved pivot valve 250 as described in the first embodiment above. The pivot valve reacts to the pressure differentials obtaining in the inlet passages 240 and 242 as previously explained, but these pressure differentials are now dependent on the degree of restriction provided by the bypass valve 262 in the bypass passage 260. When the bypass valve 262 is fully closed, the pivot valve 262 acts in the manner previously described, with the leaf corresponding to a piston moving to TDC sucked into a fully or partially open position and the other leaf closing or partially closing the passage as the other piston moves towards BDC.

With the bypass valve 262 fully open however, the suction induced by a piston moving towards TDC is reduced so that neither leaf fully closes its passage, although a sufficient charge of air or air/fuel mixture will still be inducted by a piston moving towards TDC to maintain the combustion cycle at idle. Thus the charge drawn in by a piston moving towards TDC is a function of the degree of opening of the bypass valve 262 and hence determines the power output of the engine. Again, as explained above, in practice, a butterfly valve may be provided solely for the purpose of engine idle adjustment.

Fourth Preferred Embodiment

Figure 5:
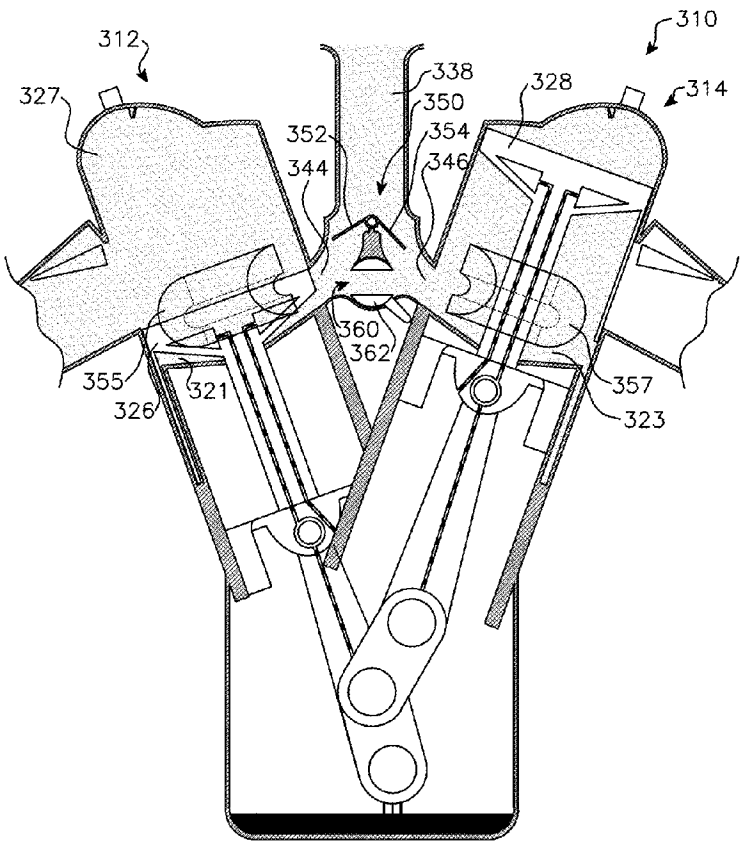
FIG. 5 is a further sectioned side view of the engine of FIG. 4 with the bypass valve in a fully open position.
Figure 4:
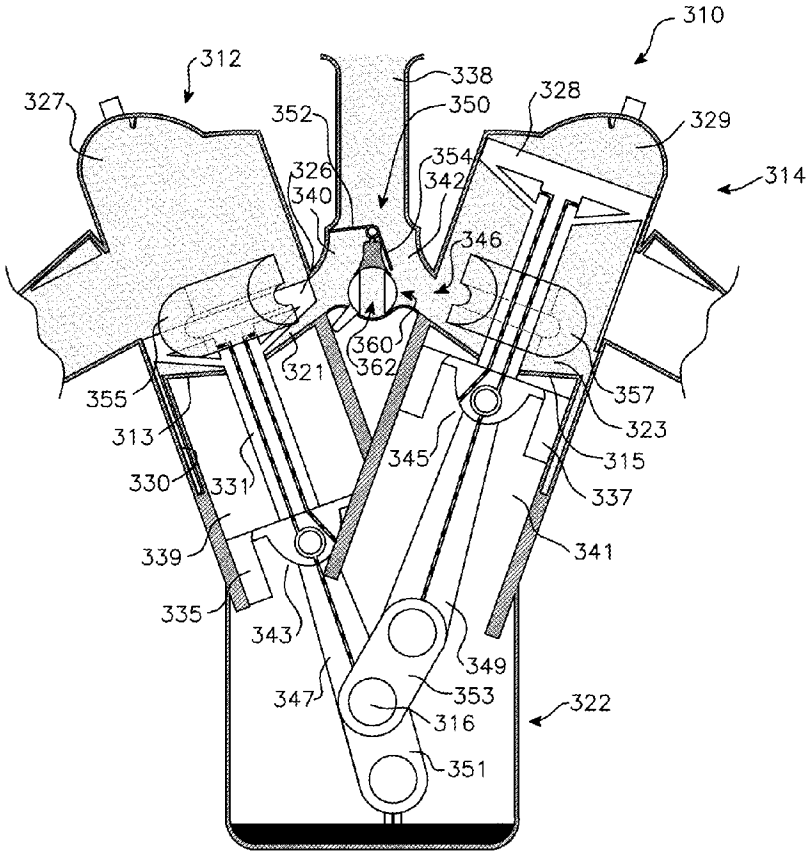
FIG. 4 is a schematic sectioned side view of a further preferred embodiment of a paired cylinder two-stroke engine according to the invention with a bypass valve in a fully closed position.

In a further preferred embodiment of the invention with reference to FIGS. 4 and 5, a two-stroke combustion engine 310 again includes at least one set of paired cylinders 312 and 314, but in this instance, the cylinders share a common crankcase 322 as well as a common crankshaft 316. The pistons 326 and 328 operate at 180 degrees so that, as illustrated in FIGS. 4 and 5, when the first piston 326 in the first cylinder 312 is at BDC, the second piston 328 in the second cylinder 314 is at TDC.

In the present embodiment, each of the cylinders 312 and 314 is divided by fixed separator plates 313 and 315 respectively, into upper and lower cylinder sections, with each of the first and second pistons 326 and 328 moving reciprocatingly between their respective fixed separator plates 313 and 315 and the upper portions of their respective cylinders. Thus each piston divides its upper cylinder section into combustion chamber portions 327 and 329 respectively above the pistons, and an induction chamber portions 317 and 319 respectively between the fixed separator plates 321 and 323 and the undersides of the pistons. An annular well . . . surrounds the lower cylinder section and is of sufficient depth to accommodate the piston skirt 330 as the piston descends to BDC.

Posts, 331 and 333 extend from an underside of each piston and pass through a central aperture in the respective separator plates 313 and 315. The lower ends of these posts 331 and 333 are connected to a vented disc or slipper-like elements 335 and 337 which are guided in lower cylinder sections 339 and 341, below the separator plates. These disc elements 335 and 337 are provided at their undersides with gudgeon elements 343 and 345 for connection to first ends of connecting rods 347 and 349. The connecting rods in turn are conventionally connected at their second ends to journals 351 and 353 of the common crankshaft 316.

Each cylinder 312 and 314 is provided with a transfer port 355 and 357 respectively, providing communication for gas transfer from the compression chamber portions 321 and 323 to the combustion chamber portions 327 and 329 of the cylinders.

As described for the second and third embodiments above, this fourth, embodiment of the invention also provides for communication between the inlet ports 344 and 346 of each of the pair of cylinders 312 and 314 by means of a bypass passage 360 between the inlet ports 344 and 346. Located in this bypass passage 360 and as also described above, is a by-pass valve 362 which is adjustable between the fully closed position shown in FIG. 4 and a fully open position shown in FIG. 5, and which is under the control of the user of the engine. In this embodiment also, by-pass valve 362 controls the power output of the engine, acting as a throttle and replacing the function of a conventional air or air/fuel inlet butterfly valve as explained above.

As for the above described embodiments, a common air or air/fuel inlet conduit 338 is bifurcated into inlet passages 340 and 342 leading to the respective cylinder inlet ports 344 and 346. Similarly, a valve system is located at or proximate the bifurcation point of the inlet passage 338 and comprises a valve for each of the inlet passages 340 and 342 extending to the inlet ports 344 and 346. These valves may take the form of reed or other known induction valves as described for the second preferred embodiment above, but optionally, comprises a single element two-leaved pivot valve 350 as previously described in the first and third embodiments and shown in FIG. 5.

The leaves 352 and 354 of the pivot valve 350 are fixed relative one to the other so that when leaf 352 closes the inlet passage 340 leading to the inlet port 344 of the first cylinder 312, the other leaf 354 assumes a fully open position in the inlet passage 342 of the second cylinder 314.

Operation—Full Power

A cycle of the engine 310 of the above fourth embodiment shown in FIGS. 4 and 5, will now be described when the by-pass valve 362 is in the fully closed position shown in FIG. 4.

Considering the cycle of the second cylinder 314 as depicted in FIG. 4, a charge of air (or air/fuel mixture) is initially inducted into the compression chamber portion 323 as the second piston 328 moves towards TDC. Due to the partial vacuum created by the rising piston 328, the second leaf 354 of the pivot valve 350 opens to allow the charge to flow from the common inlet conduit 338 through the inlet passage 342, and via the inlet port 346 of the second cylinder 314 into its compression chamber portion 323.

It will be noted that at the same time, because of the positive pressure created in the first compression chamber 321 by the first piston 326 moving to BDC, the first leaf 352 of the pivot valve 350 is urged into the closed position. On the power down-stroke of the second piston 328 and the rising up-stroke of the first piston 326, the disposition of the pivot valve 350 reverses, closing the second inlet passage 342 and opening the first inlet portion 340.

The charge of air (or air/fuel mixture) in the second compression chamber portion 323 is then transferred to the combustion chamber portion 329 via the transfer port 357 as the second piston 328 moves towards BDC. This transfer of the air or air/fuel mixture initially inducted into the compression chamber portion 323 occurs since both the pivot valve leaf 354 has closed the second inlet passage 342 and the by-pass valve 362 is also closed.

The air (or air/fuel mixture) is compressed in the second combustion chamber portion 329 as the second piston 328 moves towards TDC, and ignition, and the power down-stroke of the second piston 328 follow.

The same process just described occurs of course also in the first cylinder 326 with a lag of 180 degrees.

It will be noted that in the cycle just described, there is no modulation of the volume of inducted air (or air/fuel mixture); that is, there is no restriction (other than that offered by the sizing of the inlet conduit, inlet passage and inlet port) of the inducted flow of air or air/fuel mixture and the inducted charge is a maximum. Thus under this arrangement with the by-pass valve 362 fully closed, the engine operates at full power.

Operation—Part Power and Idle

The by-pass valve 362 of the invention, when partially or fully open as shown in FIG. 5, allows for a transfer of air or air/fuel mixture between the two compression chamber portions 321 and 323 of the two cylinders 312 and 314. Thus, when for example the first piston 326 is on its power down-stroke, the air or air/fuel mixture in the first compression chamber portion 321 is only partially forced through the transfer port 355 to the first combustion chamber 327. At least a portion, the volume depending on the degree of opening of the by-pass valve 362, may be transferred across to the compression chamber 323 of the second cylinder 314, now under partial vacuum pressure due to the rising of the second piston 328 towards TDC. An open or partially open bypass valve causes a condition favoring the "short-circuiting" of high and low pressure charges of the paired cylinders alternating with the opposing actions of the pistons.

Because of the relief in pressure in the first compression chamber portion 321 and the first inlet passage 340 connecting the inlet conduit 338 to the first inlet port 344, the pivot valve 350 reacts proportionally to the degree of relief offered by, the by-pass valve 362. Although reduced, the pressure on the first cylinder 312 side of the engine will be greater than that on the second cylinder 314 side while the first piston 326 is descending towards BDC and the second piston 328 is rising towards TDC, so that the pivot valve 350 will assume a tendency towards, but not full closure of the first inlet passage 340 and a tendency towards opening, though not necessarily full opening, of the second inlet passage 342. Although the leaves of the pivot valve are rigidly joined together, the leaves themselves allow some flexing thus allowing some leads and lags in the opening and closing of the passages.

Again this sequence is repeated for the second cylinder 328 with the pivot valve 350 reversing its position.

(It will be understood that the pressure relief effect also applies to the second and third preferred embodiment arrangements described above. In those arrangements, it is a transfer through the bypass passage of the inducted air or air/fuel mixture, between the first and second crankcases which reduces the pressures obtaining in the inlet passages.)

The first effect is that a weaker charge of air or air/fuel mixture is available for compression in the combustion chambers leading to a reduced, slower power stroke and thus a reduction in rpm and power output. The by-pass valve 362, first and second inlet passages 340 and 342, and the pivot valve 350 are so sized, that when the by-pass valve 362 is fully open, sufficient air or air/fuel mixture passes to the combustion chambers to maintain the engine at idle.

The second effect is that the work required to overcome the "pumping" action of the pistons in a conventional engine as the pistons "suck" against a closed butterfly valve, is virtually eliminated, leading to improved economy and efficiency.

The combination of features of the above described embodiment thus offers a number of advantages.

Firstly, the bypass passage and by-pass valve operating between the inlet ports of the cylinders of paired cylinders reduces the pressure differentials when the by-pass valve is partially open for partial power and fully open at idle, improving fuel economy.

Secondly, the provision of a compression chamber portion isolated from the crankcase as in the fourth preferred embodiment, offers the possibility of a fully pressurized lubrication system, increasing the longevity of the engine and allowing use of simpler and cheaper slipper bearings for the main and connecting rod journal bearings.

Thirdly, in a preferred arrangement, the inlet conduit 338 and inlet passages 340 and 342 provide only air to the compression and combustion chambers. Precisely metered fuel, proportionate to the status of the by-pass valve 362 is introduced by direct injection into the combustion chambers 327 and 328, significantly reducing fuel use and pollution.

Some other advantages accruing from the combination of features of the fourth preferred embodiment include, elimination of oil/petrol mixing, and the burning of such lubricating oil with resultant emissions, it permits a pressurized lubrication system, allows for a one-piece crankshaft with slipper bearings, eliminates the need for crankcase sealing, requires no camshaft, valves or springs and as well, offers the possibility of diesel configuration.

It, will be appreciated that in each of the above described embodiments, pairs of paired cylinders may be arranged in-line to form V-4, V-6, V-8 and other V-form multiple cylinder engines with a common crankcase and crankshaft. Nor need the paired cylinders be arranged in a V-formation; the cylinders of each pair could be horizontally opposed, or radially positioned.

The above describes only some embodiments of the present invention and modifications, obvious to those skilled in the art, can be made thereto without departing from the scope of the present invention.

The invention claimed is:

1. A two-stroke internal combustion engine comprising:

at least one set of paired first and second cylinders;

an air or air/fuel mixture inlet conduit bifurcated into inlet passages extending to respective first and second inlet ports of said first and second cylinders; and a pivoting two-leaved inlet valve comprising two rigidly interconnected leaves; said pivoting inlet valve located at said bifurcation of said inlet conduit;

wherein said pivoting two-leaved inlet valve alternately pivoting such that a first leaf of said two-leaved pivot valve opens said first inlet passage as a piston of said first cylinder moves from bottom dead centre (BDC) to top dead centre (TDC); and a second leaf of said pivoting two-leaved inlet valve closing said second inlet passage as a piston of said second cylinder moves from TDC to BDC.

2. The engine of claim 1, wherein said engine is further provided with a bypass passage extending between said first and second inlet ports of said first and second cylinders; said bypass passage provided with a bypass valve operable by an operator of said engine, and movable between a fully open position and a fully closed position of the bypass passage.

3. The engine of claim 2 wherein said first and second cylinders share a common crankcase and are divided into upper and lower cylinder sections by fixed separator plates; the first and second pistons moving reciprocatingly between TDC and BDC in respective said upper cylinder sections.

4. The engine of claim 3 wherein each of said first and second pistons divides respective upper cylinder sections of said paired first and second cylinders into a compression chamber portion and a combustion chamber portion; respective said compression chamber portions located between an underside of respective said pistons and respective said fixed separator plates.

5. The engine of claim 4 wherein, when said bypass valve is partially or fully open, said bypass passage allows a transfer of air or air/fuel mixture between said compression chamber portion of said first cylinder and said compression chamber portion of said second cylinder.

6. The engine of claim 5 wherein an open or partially open bypass valve causes a relief in pressure in said compression chamber portion and corresponding said inlet passage when said piston in that cylinder moves towards BDC; said pivot valve reacting proportionally to a degree of relief caused by said bypass-valve.

7. The engine of claim 6 wherein said pivot valve tends towards at least partial closure of an inlet passage of a first cylinder of said paired first and second cylinders when said piston in said first cylinder moves towards BDC; said pivot valve tending towards at least partial opening of an inlet passage of a second cylinder of said paired first and second cylinders.

8. The engine of claim 6 wherein, when said bypass passage is fully or partially open, weaker charges of air or air/fuel mixture for compression are transferred to said combustion chamber portions; said charges reduced from said maximum charges; said weaker charges leading to a reduced, slower power stroke and a reduction in rpm and power output.

9. The engine of claim 8 wherein said charge of air or air/fuel mixture is a charge of air only; each of said first and second combustion chambers provided with a fuel injector for delivery of a precisely metered volume of fuel; said volume proportionate to the status of said bypass valve.

10. The engine of claim 6 wherein said bypass valve, said first and second inlet passages, and said pivot valve and said inlet conduit are so sized, that when said bypass valve is fully open, sufficient air or air/fuel mixture passes to said combustion chamber portions to maintain said engine at idle.

11. The engine of claim 3 wherein a post extends from an underside of each said piston; said post passing through a central aperture in said fixed separator plate; a lower end of said post connected to a disc or slipper-like element moving reciprocatingly in said lower cylinder section; said disc or slipper-like element provided at an underside with a gudgeon element for connection to a first end of a connecting rod connected at a second end to a journal of a common crankshaft.

12. The engine of claim 11 wherein a charge of air or air/fuel mixture inducted into said compression chamber portion of a cylinder of said paired first and second cylinders as a piston in that cylinder moves towards TDC, is subsequently at least partially transferred to respective said combustion chamber portion of said cylinder through a transfer port.

13. The engine of claim 2 wherein said charges of air or air/fuel mixture inducted into a said compression chamber portions is a maximum charge when said bypass valve is in a position closing said bypass passage.

14. The engine of claim 1 wherein first and second pistons of said at least one set of paired first and second cylinders operate on a common crankshaft; and are pivotally connected by respective connecting rods to first and second journals of said common crankshaft.

15. The engine of claim 1 wherein each of said first and second cylinders is provided with a separate crankcase.

16. The engine of claim 1 wherein respective first and second pistons of said at least one set of paired first and second cylinders, reciprocate alternately between BDC and TDC of respective said cylinders; said pistons arranged at 180 degrees when a first of said pistons is at TDC a second of said pistons is at BDC.

17. A method of controlling induction of an air or air fuel mixture into paired first and second cylinders of a two-stroke internal combustion engine, comprising:

providing a pivoting two-leaved pivot valve at a bifurcation of an inlet conduit of said engine, wherein, leaves of said two-leaved pivot valve rigidly interconnected and arranged one to the other at an angle approximately equal to the angle of bifurcation; respective inlet passages extending from said bifurcation to respective inlet ports of said paired cylinders; and pivoting the two-leaved pivot valve, thereby opening and closing said inlet passages.

18. The method of claim 17 further comprising:

a bypass valve located in a bypass passage extending between said inlet port of said first cylinder and said inlet port of said second cylinder;

operating the engine at maximum power output when said bypass valve fully closes said bypass passage; and operating the engine at idle when said bypass valve fully opens said bypass passage; said pivot valve alternately fully opening and fully closing each of said inlet passages when said bypass valve is fully closed.

* * * * *